US005782277A

United States Patent [19]

Ung

[11] Patent Number: 5,782,277

[45] Date of Patent: Jul. 21, 1998

[54] CONTAMINATION-FREE FREIGHTING AND STORING SYSTEM FOR CONTAINERIZED BULK GOODS AND OPERATIVE MECHANISM THEREOF

[76] Inventor: Lu-Hsiung Ung, Fl. 2, No. 5, Lane 3, Hsing Tong Street, Taipei, Taiwan

[21] Appl. No.: 666,865

[22] Filed: Jun. 19, 1996

[51] Int. Cl.[6] ..... B65B 1/04; B65B 3/00; B67C 3/00

[52] U.S. Cl. ..... 141/352; 141/65; 141/93; 141/351; 141/346; 141/364; 298/29; 298/31; 105/240; 105/377.05; 105/377.06

[58] Field of Search ..... 141/65, 93, 351, 141/352, 353, 354, 346, 364; 298/24, 29, 31; 105/240, 244, 246, 377.05, 377.06

[56] References Cited

U.S. PATENT DOCUMENTS

| | | | |
|---|---|---|---|
| 483,360 | 9/1892 | Ludlow | 105/246 |
| 1,282,417 | 10/1918 | Harvey | 105/377.05 |
| 1,474,703 | 11/1923 | Barth | 105/246 |
| 3,123,107 | 3/1964 | Kappler | 141/352 |

*Primary Examiner*—Henry J. Recla
*Assistant Examiner*—Timothy L. Maust
*Attorney, Agent, or Firm*—Bucknam and Archer

[57] ABSTRACT

A contamination-free freight and storing system for containerized bulk goods adapted to the freight and storage of granular or powdered goods, comprises an improved container satisfying ISO standard, an unloading tank with a top opening, a lifting device within the unloading tank, a suction filter device and a container freight device. The bottom board of the container comprises two separate bottom panels, which are placed above the top opening of the unloading tank while unloading, and are activated by the lifting device and elevated inwardly to expose the two sides of the base of the container so that the granular goods inside the container can slide into the unloading tank. The powder formed from the material seepage can be drawn and filtered by the suction filter device and then released into the atmosphere.

8 Claims, 4 Drawing Sheets

CONTAMINATION-FREE FREIGHTING AND STORING SYSTEM FOR CONTAINERIZED BULK GOODS AND OPERATIVE MECHANISM THEREOF

FIELD OF THE INVENTION

The present invention relates to a contamination-free freighting and storing system for bulk goods, particularly it relates to a novel containerized freighting device for the transportation of granular or powdered goods, which is an operation system that can accomplish the transportation of granular or powdered goods, which is an operation system that can accomplish the transportation, freight and storage and unloading of bulk granular or powdered goods under contamination-free situations. The present invention also relates to the novel structure of containerized freighting devices

BACKGROUND OF THE PRIOR ART

Presently, it is found that the long-distance transportation of bulk goods, such as grains, coal powder, or granular goods, from point A to point B by sea is through loading such goods in the hatch of a bulk carrier. After arriving to the port, the goods are transferred into a warehouse via a conveyer belt and stored therein. After distributive packing operations, the distributively packed goods are then delivered to the users. In such a traditional transporting procedure for granular goods, a particular dock area must be delineated at both operation docks and particular equipments must be utilized therewith. However, the utilization rate of such a particular dock area tends to be low, the dock is usually under idle conditions and thus is not efficiently utilized. In addition, the slow goods loading and unloading operations proceeded at both quays are repetitive and complicated. Therefore, such operations not only waste much working time and labor which cause slow loading and unloading but also create powder in quantities accompanying the unloading operation process, powder which scatters in the atmosphere and contaminates the surrounding environment.

SUMMARY OF THE INVENTION

The object that bulk goods transportation is intended to improve upon is how to reduce the transportation cost for bulk goods, increase transportation efficiency, prevent load/unloading contamination and be able to adjust to a computer operation.

Therefore, the main object of the present invention is to provide a bulk goods freight and storing system through a containerized operation so that the bulk goods can be transported and stored in a container unit thus extensively saving the operation time for loading, unloading, transferring and distribution.

According to the present invention, the freight and storing system for containerized bulk goods does not need to utilize particular freight and storing equipments and a particular site of low utilization rate. The system only needs to utilize the original container dock operation system and transportation system thus extensively reducing the costs for loading, unloading and other post distribution operations by the shore. This is another object of the present invention.

According to the present invention, the freight and storing system for containerized bulk goods uses an improved standardized container as a transportation unit, thus allowing the standardization of the container unloading measuring operation. After one measurement, there is no necessity to perform repetitive measuring operations until the goods are delivered to the users, a fact which consequently saves labor and working hours. This is a further object of the present invention.

According to the present invention, the freight and storing system for containerized bulk goods uses an improved container, the outer dimensions of which satisfy ISO standard so that the weight of the goods is consistent and can adjust to a computer customs-clearance operation which worldwide busy ports anticipate to adopt.

According to the present invention, the freight and storing system for containerized bulk goods can containerize the freight and storage of bulk goods and accommodate to the low-cost railway transportation thus expeditiously delivering the bulk goods to transferring terminals. If the system is further incorporated with the roadway transportation, the system can also expeditiously execute distribution. This is another object of the present invention.

According to the present invention, the freight and storing system for containerized bulk goods can store the goods in an enclosed container, thus it can adapt to dehydrated grains and avoid the occurrence of fermentation and decomposition thereof. The system can also adapt to dry coal powder being pulverized from coarse coal, whereby preventing self-ignition and obtaining a safer transportation process. This is another object of the present invention.

A further object of the present invention is to provide an improved standard container which can adapt to the expeditious unloading of bulk goods, wherein the bottom of the container comprises two separate bottom panels which can be elevated towards the interior of the container. The two separate bottom panels can be elevated at the intersection thereof by an external force which causes the two separate bottom panels being elevated to achieve a mountain-like shape, so that the granular goods laid on the bottom panels can swiftly slide out of the container due to gravity. Therefore, the utilization of the present invention allows to unload goods expeditiously and without effort.

According to the improved standard container provided by the present invention, the container is occasionally placed above an unloading tank with a top opening during unloading and a suction filter equipment is provided with the unloading tank. Thus during the period when the two separate bottom panels of the container are elevated to perform expeditious unloading, the scattered powder which is formed is completely enclosed in the unloading tank and drawn by the suction equipment. The scattered powder is filtered by a filter screen or a water tank and is then released to the atmosphere. Therefore utilization of the improved container of the present invention will not result in the possibility of contaminating the surrounding environment during unloading. This is another object of the present invention.

The aforementioned contamination-free freight and storing system for containerized bulk goods and operative mechanism thereof of the present invention can be further realized by the following detail description accompanied with the following drawings of which:

FIG. 1 is a cross-sectional view illustrating a container under an enclosed condition according to the present invention;

FIG. 1*a* is another embodiment of the two separate top panels at the connecting location thereof as illustrated in FIG. 1;

Figure 1:
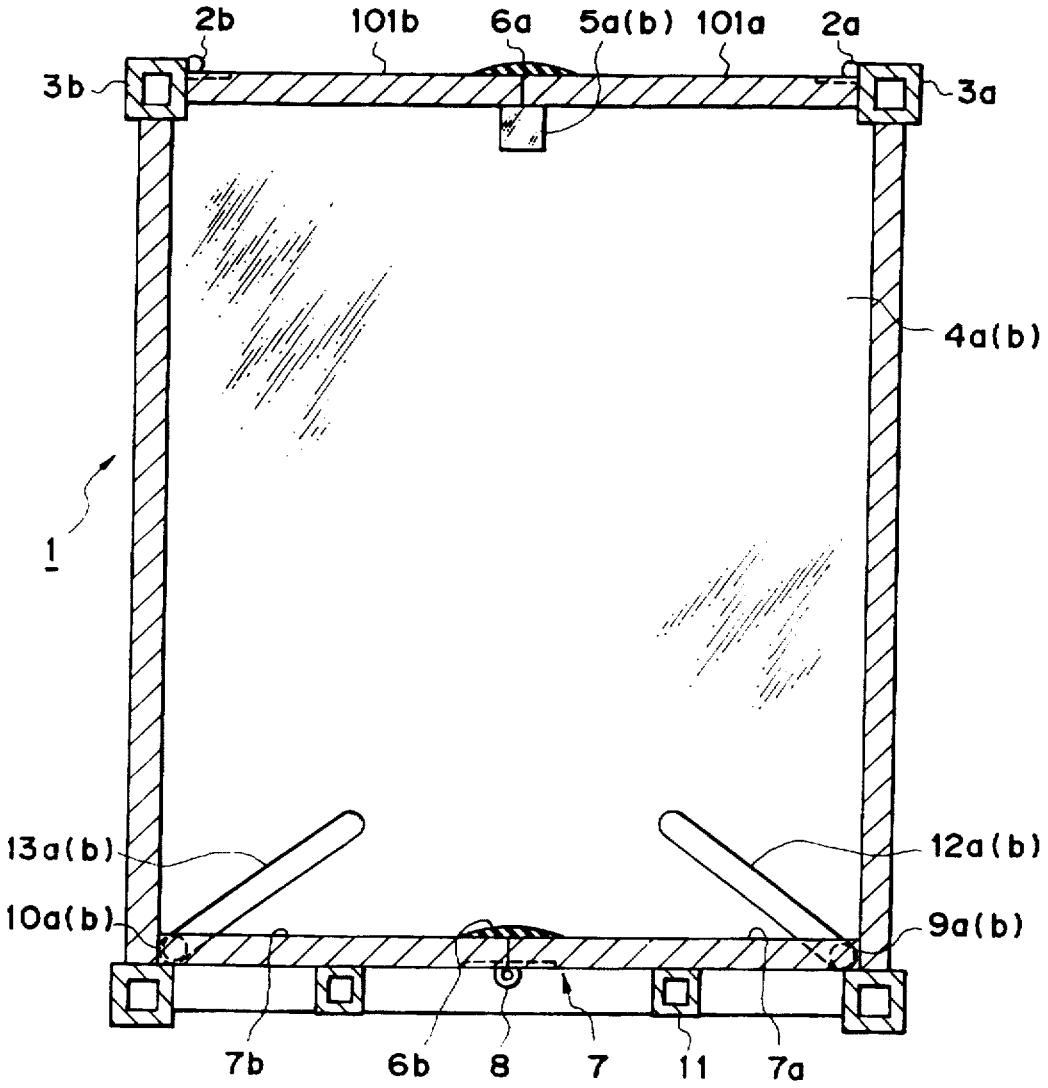
Figure 1A:
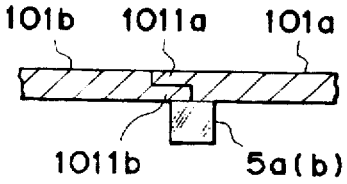

First by reference to FIG. 1 a container device 1 adapted to the freight and storage of containerized goods according to the present invention is shown. The outer dimensions of the container device, (the term "container" will be used hereafter for convenient explanation,) are identical to those of ISO standards. The container 1 has four side walls as a conventional container, the difference is the improvements at the top and bottom boards thereof. The constructions with respect to the top and bottom boards will be further explained. The top board comprises two separate top panels 101*a* and 101*b*, and the opposite sides thereof are respectively pivoted on the top of the two longitudinal side walls (or pillars) 3*a* and 3*b* by a plurality of hinges 2*a* and 2*b* so that the two separate top panels 101*a* and 101*b* can flip outwardly according to the direction of the arrow as a loading device. In addition, two stop blocks 5*a* and 5*b* are secured on the front and rear side walls 4*a* and 4*b* to prevent the two separate top panels 101*a* and 101*b* from rotating towards the interior of the container after being shut, and to retain the two separate top panels under leveled conditions. A resilient covering strip 6*a* is secured on one of the top panels along the longitudinal intersection line of the two separate top panels, the opposite ends of the two separate top panels can alternatively be constructed as shown in FIG. 1*a*, i.e., the opposite ends are constructed with recesses 1011*a* and 1011*b* and can be overlaid to form a flat surface.

Now referring to FIG. 1, the bottom board 7 of the container 1 also comprises two separate bottom panels 7*a* and 7*b*, amd the intersection thereof is pivotally connected by a plurality of hinges 8 in the middle. A resilient covering strip 6*b* is also provided at the intersection inside the container. In addition, rolling wheels 9*a* (9*b* not shown) and 10*a* (10*b* not shown) are respectively secured on the lower left side of the front and rear ends (which are the ends perpendicular to the paper) of the separate bottom panel 7*a* and the lower right side of the front and rear ends of another separate bottom panel 7*b*. The rolling wheels are also kept inside of the inclined slots 12*a* (*b*) and 13*a* (*b*) at the front and rear side panels 4*a* (4*b* not shown) and guided therein. A grid board 11 composed of longitudinal and transverse pillars is secured beneath the bottom panels 7*a* to hold the two separate bottom boards 7*a* and 7*b*.

For using the container 1 of the containerized freight and storing system according to the present invention as shown in FIG. 1 to load granular goods, first the two separate top panels 101*a* and 101*b* are flipped outwardly and the two separate bottom panels 7*a* and 7*b* are closed. The transported granular goods can then be transferred and introduced into the container by a conveyer belt. Then the two separate top panels 101*a* and 101*b* are shut to form a freight and storing unit, as shown in FIG. 1, after a predetermined quantity is introduced therein. Finally, the quay side operation and transporting processes with respect to such a freight and storing unit of the present invention are executed as with a conventional container transporting equipment, thus there is no necessity to increase or modify the existing equipments.

Figures 3, 4:
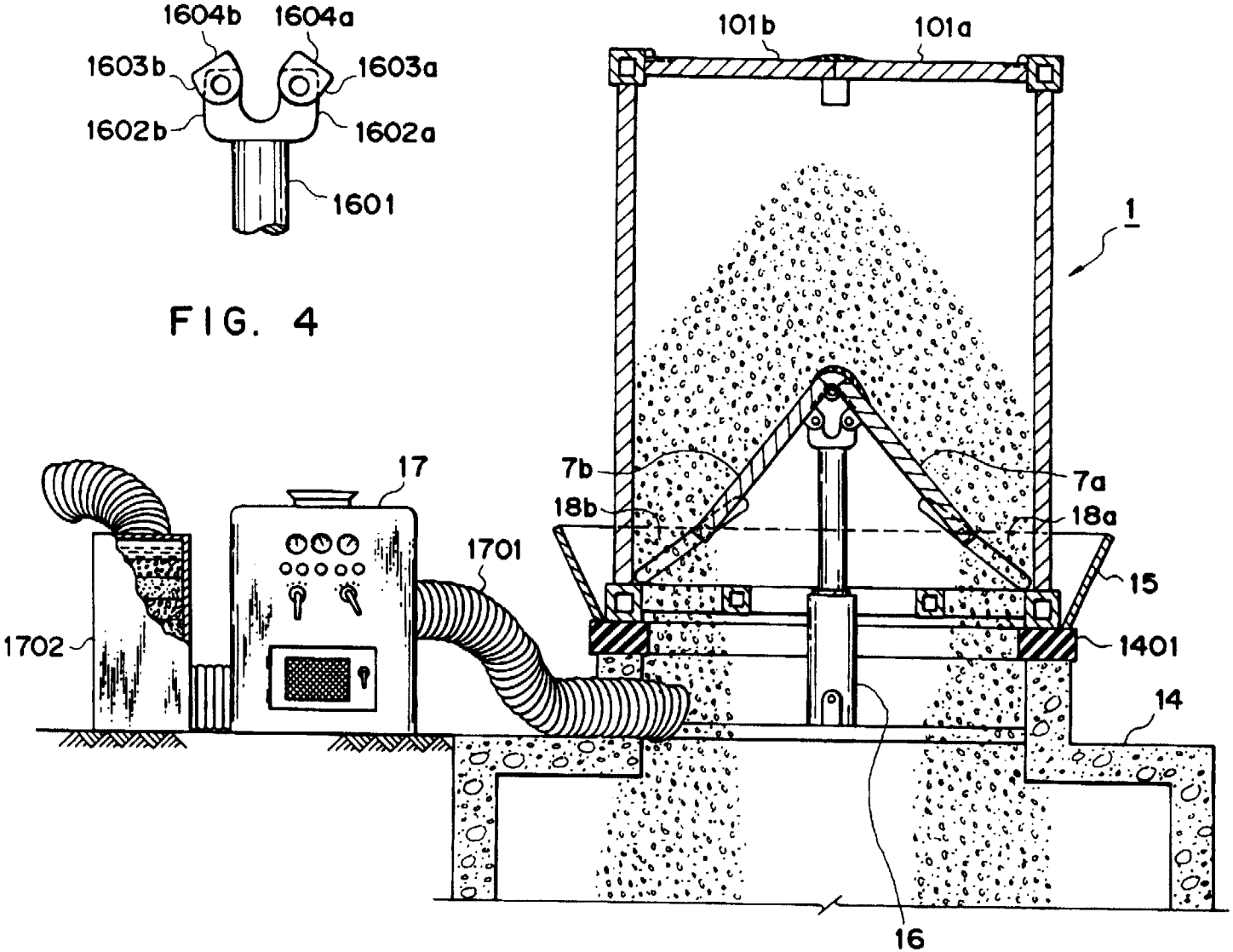
FIG. 3 is a schematic view illustrating the container of FIG. 1 under a contamination-free unloading process.
FIG. 4 is an enlarged view of the circled portion as illustrated in FIG. 3.
Figure 5:
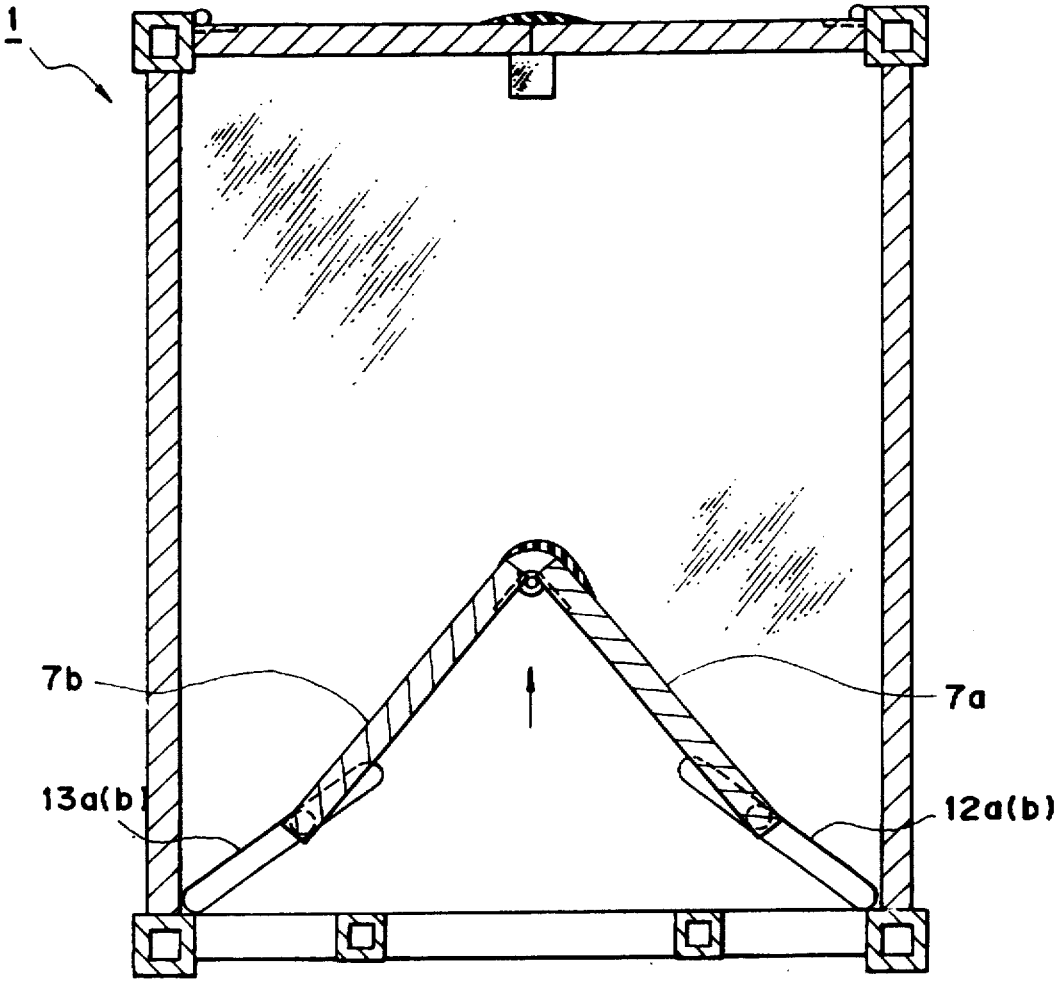
FIG. 5 is a cross-sectional view of an external force being applied to the bottom panels and causing the bottom panels to elevate inwardly and expose the space at the two sides.

According to the present invention, after the good-sloaded container 1 is transported to the user an unloading operation is desired, as illustrated in FIG. 3 and 5. The container 1 is placed above an unloading tank 14. The unloading tank 14 has a top opening, the capacity of the unloading tank is at least as large as that of the container 1. A resilient pad 1401 is placed on the top of and around the unloading tank and a guide board 15 tapered outwardly is secured around the resilient pad 1401 to form the construction shown in FIG. 3. In addition, a plurality of lifting devices, such as jacks or hydraulic lifts, are provided at the center location inside the unloading tank 14. The present embodiment utilizes hydraulic lifts 16 as an example. As shown in FIG. 4, two separate members 1602*a* and 1602*b* are formed at the top of a piston rod 1601 of the hydraulic lift 16 and two tackles 1063*a* and 1603*b* are, respectively, pivoted on top of the separate members 1602*a* and 1602*b*. Flat surfaces 1604*a* and 1604*b* are formed on top of the tackles 1603*a* and 1603*b*.

Also, a suction filter equipment 17 is provided at the external side of the unloading tank 14 and the nozzle tube thereof extends into the unloading tank 14.

When power is activated on the lifting device 16, as shown in FIG. 4, the two tackles 1603*a* and 1603*b* on top of the piston rod 1601 abut the two sides of the intersection of the two separate bottom panels 7*a* and 7*b* with the flat surfaces 1604*a* and 1604*b*, respectively. As shown in FIG. 3, while the piston rod 1601 continues to be elevated, the rolling wheels 9*a* and 10*a* slide along the inclined guide slots 12*a* and 13*a*, respectively, the two separate boards 7*a* and 7*b* are lifted and elevated to achieve a mountainlike shape at the pivoted location thereof. Therefore, passages 18*a* and 18*b* are exposed so that the granular goods in the container 1 can conform to the inclined state of the two separate bottom panels 7*a* and 7*b* and thus slide out. While the two separate bottom panels continue to be elevated, the granular goods in the container 1 also continuously slide into the unloading tank 14 and the unloading can be accomplished in an extremely short period of time. During this period of the unloading operation, the large quantity of powder formed in the enclosed unloading tank is drawn out by the suction filter device 17, at all times, and passes a filter screen or enters a water tank 1702. Therefore, the container can be lifted almost without any waiting period after completing expeditiously the unloading and without a concern that the scattered powder or dust is spread out of the container causing the contamination of surrounding environment. In addition, if the unloaded goods are granular coal, the granular coal can be recycled after subsiding in the water tank 1702.

Figure 2:
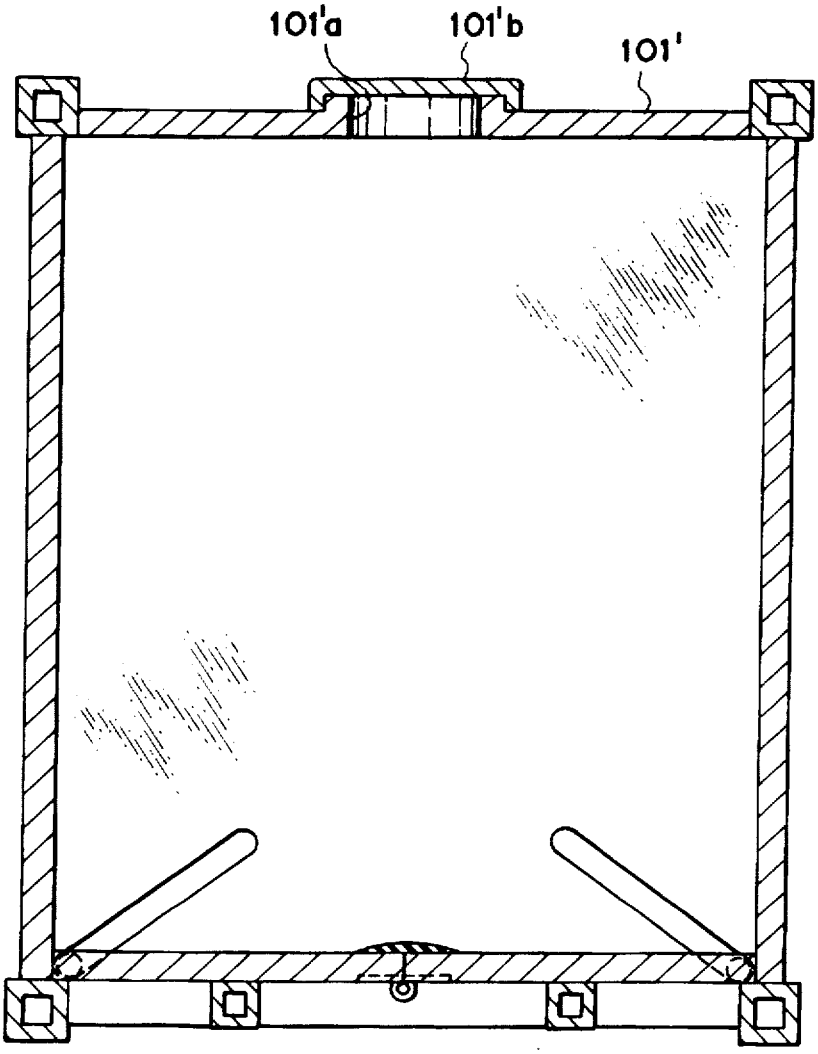
FIG. 2 is a cross-sectional view illustrating a different form of the container with loaded goods.

FIG. 2 is the second embodiment according to the present invention, which provides a container 1', having two separate bottom panels. The difference between the container 1' and that of FIG. 1 is that the top board thereof does not comprise two separate panels, but a plurality of loading holes 101'*a* are formed on top of the top board 101' as a loading location and covers 101'*b*, respectively, cover each of the loading holes 101'*a*.

In summary, the utilization of the freight and storing system for containerized bulk goods provided by the present invention allows powdered and granular goods to use a container as a freight and storing unit for the containerization of freight and storing granular or powdered goods. The present invention extensively increases the efficiency of freight and storing processes and the unloading process can be accomplished expeditiously under contamination-free situations. Therefore, the present invention is indeed a novel invention.

What is claimed is:

1. A contamination-free freighting and storing system for containerized bulk goods adapted for the expeditious loading of freight, storage and unloading of dry granular or powdered goods, the system comprising:

a container (1) (1') freighting device which satisfies ISO standards and having a front wall (4*a*), a rear wall (4*b*) and two side walls (3*a*) and (3*b*) and a top board, a bottom board, an unloading tank (14) having a top opening, a lifting device (16) provided in said unloading tank, a suction filter device (17) located externally of said unloading tank and connected thereto and conventional container transporting equipment; wherein said bottom board comprises two separate bottom panels (7*a*) and 7(*b*);

a loading device placed on said top board, above said top opening of said unloading tank;

each of said two separate bottom panels having a side and when they are activated by said lifting device (16) they elevate into said container to achieve a mountain-like shape and expose said sides whereby said goods inside said container can expeditiously fall into said unloading tank; and the powder which is formed during the unloading process is drawn and filtered by said suction filter device.

2. The system according to claim 1, wherein said front wall (4*a*) and said rear wall (4*b*) have a lower portion and have a plurality of inclined guide slots (12*a*) (12*b*) (13*a*) (13*b*), said bottom panels (7*a*) (7*b*) have a lower portion at the front and rear ends, said two separate bottom panels (7*a*) (7*b*) are pivotally connected by a plurality of hinges (2*a*) (2*b*), a plurality of rolling wheels (9*a*) (9*b*) (10*a*) (10*b*) are respectively pivoted at said lower portions of said bottom panels (7*a*) and (7*b*) and said rolling wheels are guided by said plurality of guide slots (12*a*) (12*b*) (13*a*) (13*b*) at the front and rear ends of said two separate bottom panels and said rolling wheels are guided by said plurality of guide slots (12*a*) (12*b*) (13*a*) (13*b*) at the front and rear walls of said container in order to elevate and depress said two separate bottom panels along said guide slots.

3. The system according to claim 1 wherein said container has an area at the bottom thereof, said opening in said top of said unloading tank (14) has an area larger than the area of the bottom of said container, a resilient pad (1401) is provided around the edges of said opening, and a guide board tapered outwardly is secured around said resilient pad.

4. The system according to claim 1 wherein said loading device placed on said top board of said container can flip outwardly.

5. The system according to claim 4 wherein said loading device comprises two separate top panels (101*a*) (101*b*), said top panels having sides opposite to each other, said side walls of said container (3*a*) (3*b*) having a top, said sides of said top panels opposite to each other being pivoted on said tops of said walls of said container, and a plurality of stop blocks (5*a*) (5*b*) are secured on said front and rear side walls (4*a*) (4*b*).

6. The system according to claim 1 wherein said separate top panels (101*a*) (101*b*) have opposite ends provided with recesses (1011*a*) (1011*b*), said recesses being provided with a cover to form a flat surface.

7. The system according to claim 1 wherein said top panels (101*a*) (101*b*) intersect and a strip (6*a*) is secured on one of said top panels.

8. The system according to claim 1 wherein said loading device on said top board has a plurality of loading holes (101'*a*) and a plurality of covers (101'*b*) for covering each of said loading holes.

* * * * *